US005436430A

United States Patent [19]

Baruch et al.

[11] Patent Number: 5,436,430

[45] Date of Patent: Jul. 25, 1995

[54] ROLLER FUSER HAVING A TEMPERATURE CONTROL

[75] Inventors: Susan C. Baruch; Stephen G. Keller, both of Rochester, N.Y.

[73] Assignee: Eastman Kodak Company, Rochester, N.Y.

[21] Appl. No.: 163,971

[22] Filed: Dec. 6, 1993

[51] Int. Cl.[6] ..... G03G 15/20

[52] U.S. Cl. ..... 219/216; 355/290

[58] Field of Search ..... 355/282, 285, 289, 290; 219/216, 469

[56] References Cited

U.S. PATENT DOCUMENTS

| | | | |
|---|---|---|---|
| 4,318,612 | 3/1982 | Brannan et al. | 355/289 |
| 4,348,102 | 9/1982 | Sessink . | |
| 4,425,494 | 1/1984 | Enomoto et al. | 219/216 |
| 4,737,818 | 4/1988 | Tanaka et al. . | |
| 4,905,051 | 2/1990 | Satoh et al. | 355/290 |
| 4,920,250 | 4/1990 | Urban | 219/216 |
| 4,977,431 | 12/1990 | Fuji | 355/289 |
| 5,019,692 | 5/1991 | Ndebi et al. | 219/469 |
| 5,019,693 | 5/1991 | Tamary | 219/471 |
| 5,239,349 | 8/1993 | Hoover et al. | 355/282 |
| 5,329,343 | 7/1994 | Saito | 355/290 |

FOREIGN PATENT DOCUMENTS

| | | | |
|---|---|---|---|
| 0077771 | 6/1980 | Japan . | |
| 0150075 | 8/1985 | Japan | 355/290 |

*Primary Examiner*—Robert B. Beatty
*Attorney, Agent, or Firm*—Leonard W. Treash

[57] ABSTRACT

A fuser for fixing toner images to a receiving sheet includes pressure and fusing rollers which are separated during idle. In response to a run signal, the temperature of the fusing roller is given a boost according to a sensed or estimated temperature of the pressure roller. At other times during both idle and run, the temperature of the fusing roller is controlled by a sensor associated with the fusing roller.

6 Claims, 2 Drawing Sheets

ROLLER FUSER HAVING A TEMPERATURE CONTROL

This invention relates to control of temperature in a roller fuser for fixing toner images to a receiving sheet.

Most heated roller fusing systems for fixing toner images to a receiving sheet internally heat a roller called the "fusing roller." An unheated pressure roller forms a nip with the fusing roller. The receiving sheet is fed into the nip with an unfixed toner image contacting the fusing roller. One of the rollers is usually softer than the other forming a curved nip.

When "on" roller fusers have at least a "run" condition when fixing images and an "idle" condition when heated but images are not being formed. Some fusers separate the rollers when the machine is off and sometimes during idle to avoid a heat set in the softer roller. When the rollers are re-engaged, the temperature of the pressure roller substantially affects fusing quality. This is not a serious problem when starting a large machine for the day, since a warmup period is required anyway, which can be used to stabilize the temperature of the pressure roller. However, when going from idle to run, it is necessary that the fuser be immediately ready to fix images.

The cooling effect of the pressure roller is less of a problem in systems in which the two rollers are left in engagement during idle. However, engagement during long periods of idle has a tendency to cause a heat set in the rollers. This is especially true if the hard roller has a taper to prevent wrinkles, which taper eventually forms in the soft roller, eliminating its effect in the hard roller. It is, thus, desirable in many fusing systems to disengage the rollers during idle despite the creation of temperature control problems associated with a cool pressure roller.

U.S. Pat. No. 5,019,693 to Tamari, issued May 28, 1991 shows a temperature control for a fusing roller in which both a core temperature and a surface temperature are sensed to overcome droop in going from an idle to a run condition in systems in which the fusing roller has a cooler idle temperature than it does a run temperature.

U.S. Pat. No. 4,318,612 to Brannan et al, Mar. 9, 1982, shows a fuser in which a cold start is distinguished from a warm start in the temperature algorithm.

U.S. Pat. Nos. 4,920,250 to Urban, Apr. 24, 1990; and 5,019,692 to Ndebi et al, May 28, 1991, show the use of temperature sensors on both the fusing roller and the pressure roller in continuously engaged roller fusing systems in which the pressure roller is heated.

U.S. Pat. No. 5,239,349 to Hoover et al, issued Aug. 24, 1993, shows a mechanism for separating a pressure roller from a fusing roller supplied to the apparatus in a fusing roller cartridge. The temperature of the fusing roller is controlled using a heat sensor which is included in the cartridge and is connectable with the logic and control of the apparatus.

SUMMARY OF THE INVENTION

It is an object of the invention to provide a fuser for fusing toner images to a receiving sheet in which a pressure roller and a fusing roller are separated during idle but with improved control of fusing quality at the beginning of a run.

These and other objects are accomplished by controlling the heat applied to the fusing roller when changing from idle to run according to the estimated or sensed temperature of the pressure roller.

According to a preferred embodiment, the heat applied to the fusing roller at the beginning of a run cycle is boosted, for example, by turning on a heating element for a period of time in response to a run signal, which time is chosen according to the sensed temperature of the pressure roller. For example, if the pressure roller temperature is low, the lamp would be turned on for a longer period of time than if the pressure roller temperature is high. Alteratively, the lamp can be turned on until the pressure roller reaches a predetermined temperature and then control can be switched back to the sensed fusing roller temperature. Alteratively, the power applied to the lamp can be made inversely related to the temperature of the pressure roller for a portion of the temperature rise time of the pressure roller with or without a variable time for the boost in heat.

By using the pressure roller temperature to control, at least in part, the boost applied to the fusing roller in response to a run signal, the fuser is able to react faster to an abnormally cold or abnormally warm pressure roller in response to a run signal than it would by giving a constant boost.

According to a further preferred embodiment, the above algorithm, dependent on the pressure roller temperature, is used only if the fusing roller temperature is not substantially above its nominal idle temperature. If the fusing roller temperature is substantially above its idle temperature, it is likely that a run has just been completed. In this instance, the boost algorithm is controlled by the fusing roller temperature to avoid overheating of the fusing nip.

DESCRIPTION OF THE PREFERRED EMBODIMENTS

U.S. Pat. No. 5,239,349, referred to above, shows a fuser in which the temperature control algorithms disclosed herein are usable. That patent is hereby incorporated by reference herein.

Figure 1:
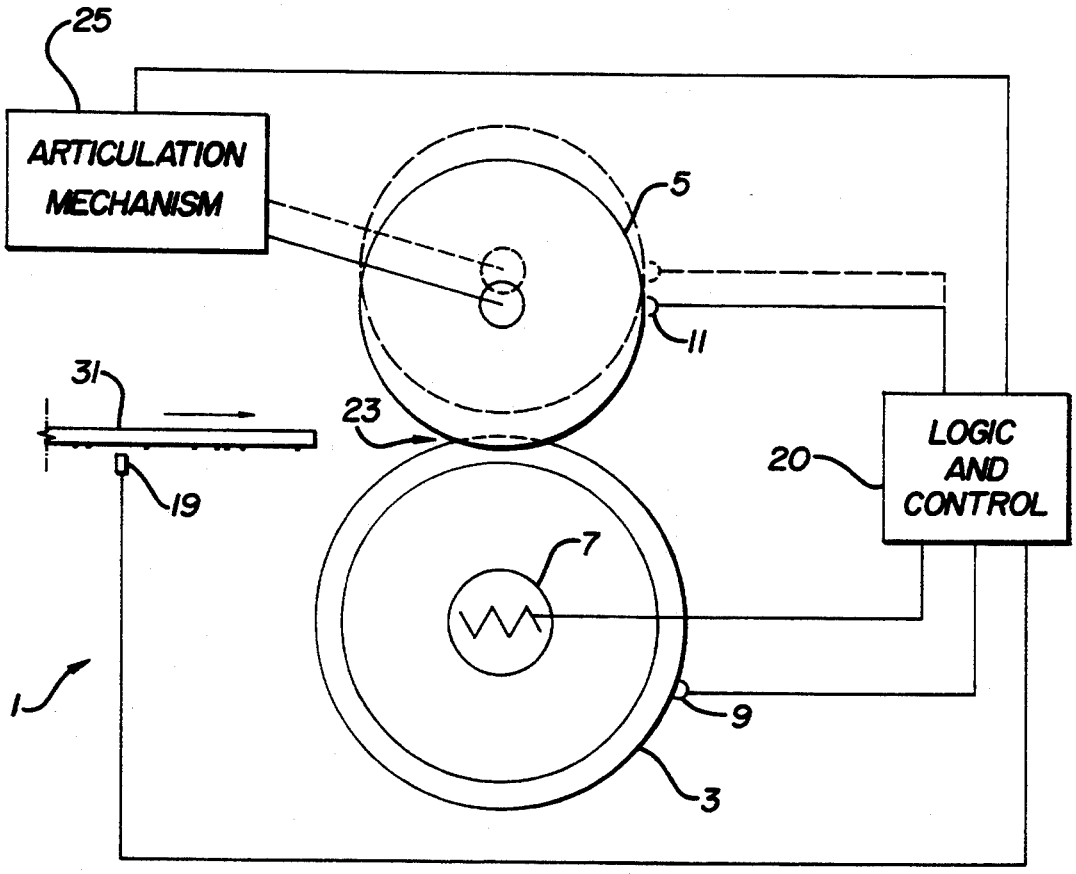
FIG. 1 is a side schematic of a fuser.

FIG. 1 shows a fuser I which includes a fusing roller 3 and a pressure roller 5. The pressure roller is movable into and out of engagement with the fusing roller by an articulation mechanism 25 under control of a logic and control 20. Logic and control 20 can be located in the fuser per se or in the main logic and control of an image forming apparatus in which the fuser is located.

When engaged, the pressure roller 5 and the fusing roller 3 form a fusing nip 23 which receives a receiving sheet 31 having a toner image on its bottom side, as seen in FIG. 1. Fusing roller 3 is slightly deformable by a hard pressure roller 5 to create an arcuate nip which helps separation of the receiving sheet from the fusing roller as it exits the nip. Arrival of a receiving sheet 31 for entrance to the nip 23 is sensed by an appropriate sensor 19 which creates an appropriate signal input to the logic and control 20. The surface temperature of the pressure roller 5 and of the fusing roller 3 are sensed by sensors 11 and 9, respectively. Each sensor creates a signal indicative of the temperature of its roller, which signal is fed to logic and control 20. Logic and control 20 also controls the power to a lamp 7 located inside fusing roller 3.

When the machine is on, the fuser has at least two modes. In a "run" mode the machine is making images and in an "idle" mode the machine is on but has not been asked yet to make images. During both modes the power applied to lamp 7 is controlled by logic and control 20, in most instances, according to the temperature sensed by temperature sensor 9 on the fusing roller 3. The run and idle temperatures can be the same temperature, for example, 350° F. or one of the temperatures can be somewhat higher than the other. Preferably, the idle temperature is slightly higher than the run temperature. Because the pressure roller 5 is unheated and is separated from the fusing roller during idle, it will cool down during idle to a temperature that is variable. When the rollers are engaged in response to a run signal, the pressure roller immediately begins to heat up as it draws heat from the fusing roller 3. Usually, the temperature in the nip will, for at least a short time, be substantially below the desired nip temperature for fixing toner images. A boost is given to the overall heat in the nip according to an algorithm illustrated in the graph in FIG. 2. The usual control using the temperature of the fusing roller is overridden and the pressure roller temperature sensed by sensor 11 is used to determine how long the lamp 7 stays on after a run signal. For example, with 500 watts maximum available power, if the pressure roller temperature is 250° F. the lamp 7 is maintained in an on condition for 38 seconds (see FIG. 2) at which point, the nip temperature is adequate to fuse a toner image, for example, a full color image.

This algorithm provides more consistent fusing and gloss for the first few images than an algorithm monitoring the output of sensor 9 on the fusing roller. This is because, although the fusing roller temperature will drop somewhat as a result of the pressure roller cooling the nip, it does not drop by as much as the overall effect the cool pressure roller has on the nip temperature. Thus, when monitoring the fusing roller temperature, less total heat will be applied with a very cold pressure roller than will be the case when monitoring the pressure roller itself. There is also a delay (when monitoring the fusing roller) in responding to the cooling of the fusing roller caused by engagement with the pressure roller. This delay is not in evidence when responding directly to the pressure roller temperature.

Although the above describes a direct approach to determining the algorithm directly from the temperature of the pressure roller, a similar result can be obtained somewhat less directly by using the pressure roller temperature to adjust the temperature setpoint of the fusing roller for the boost time. The lower the pressure roller temperature, the higher the fusing roller setpoint.

Although actually monitoring the temperature of the pressure roller is preferred, that temperature can also be estimated by keeping track of the time since the last copy and the number of copies produced in the last run. Although this is less precise than an actual measuring of the temperature, it is also somewhat less expensive in equipment cost.

Figure 2:
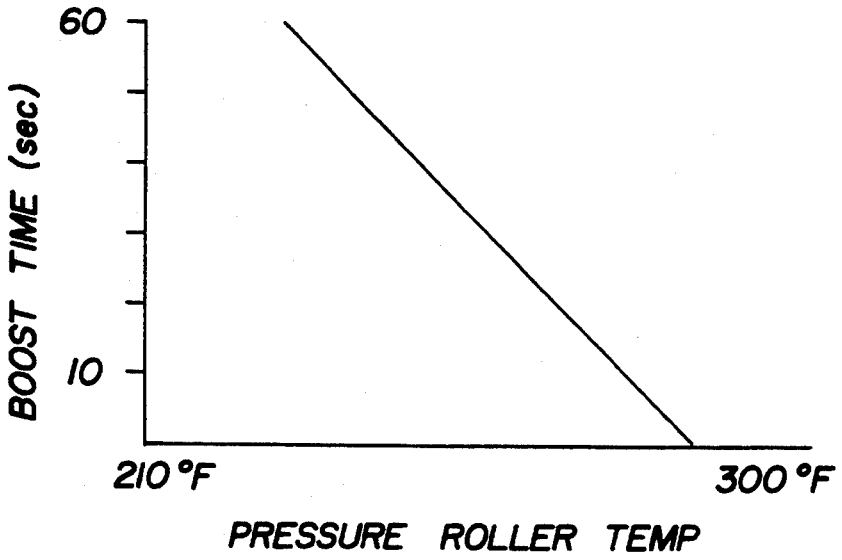
FIGS. 2 and 3 are graphs of temperature control algorithms.
Figure 3:
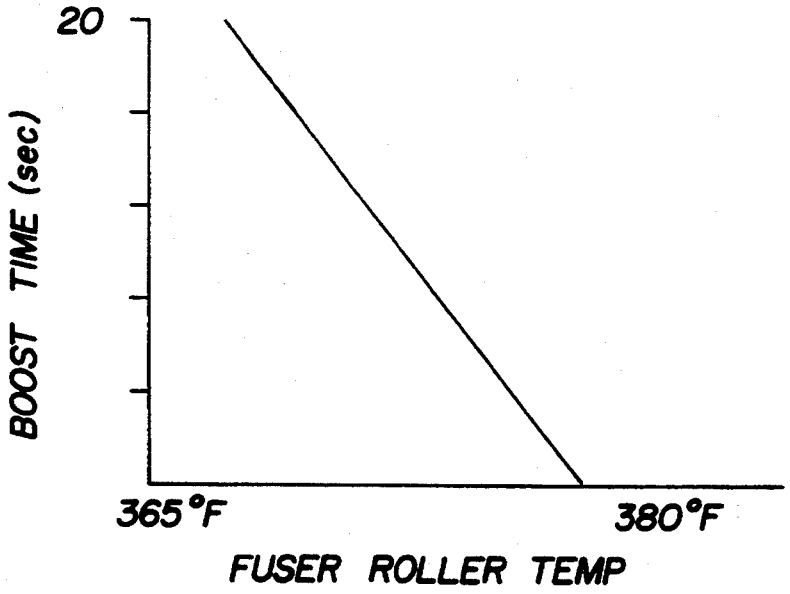

FIG. 3 illustrates a refinement to the FIG. 2 approach. In running a number of prints, it was found that image quality was preferred in nearly all cases using the pressure roller temperature as the basis for the override or boost algorithm. However, in a few cases where the fuser roller temperature had not returned to its nominal value during idle, some less desirable high gloss levels were achieved using this algorithm. This was due to the fact that a first job was short and was followed fairly soon by a second job. The algorithm, according to FIG. 2, has a tendency to a react to a still cold pressure roller by applying too much heat for an already warm fusing roller. This results in a higher gloss than intended. When a hot fusing roller is sensed, the boost is controlled by the fusing roller temperature according to the algorithm shown in FIG. 3.

For example, if a single print had just been run and another job was requested immediately thereafter, the temperature on the fusing roller may well turn out to be as high as 380° F. while the pressure roller temperature might be in the neighborhood of 250° F. Using the algorithm according to FIG. 3, a zero second boost is given, whereas the algorithm according to FIG. 2 would give a 33 second boost. Obviously, for particular rollers and applications, the threshold at which the logic and control shifts from FIG. 2 to FIG. 3 would vary and must be decided empirically in design.

We have found that a job containing two prints, followed immediately by a second job had a fusing roller temperature of about 370° F. Again, the FIG. 3 algorithm was used with a boost time of 15 seconds. This was relatively close to the boost time that would have been provided by the FIG. 2 algorithm.

Although the examples all include varying only time rather than power to the lamp, obviously, lamp power could be varied instead of time or in addition to time in providing the boost desired.

The invention has been described in detail with particular reference to a preferred embodiment thereof, but it will be understood that variations and modifications can be effected within the spirit and scope of the invention as described hereinabove and as defined in the appended claims.

We claim:

1. A fuser for fixing toner images to a receiving sheet, which fuser has a run condition and an idle condition, said fuser comprising:

a rotatable fusing roller for contacting the toner image, a pressure roller engageable with the fusing roller to form a fixing nip and rotatable with the fusing roller to feed a receiving sheet through the nip, means for heating the fusing roller, logic and control, means for engaging the rollers in response to a run signal from the logic and control and for disengaging the rollers in response to an idle signal from the logic and control, means for sensing a temperature associated with the fusing roller and for inputting a signal indicative of the temperature of the fusing roller to the logic and control, means for controlling the heating means during both run and idle according to the sensed temperature of the fusing roller, and means for overriding the controlling means in response to a run signal, to control the heating means temporarily according to a sensed or estimated temperature of the pressure roller.

2. A fuser according to claim 1 further including means for sensing a temperature associated with the pressure roller and for inputting a signal indicative of the temperature of the pressure roller to the logic and control, said means for overriding including means for controlling the heating means in response to a run signal according to the sensed temperature of the pressure roller.

3. A fuser according to claim 2 wherein said means for overriding includes means for controlling the heating means in response to a run signal according to an algorithm in which the amount of heat applied to the fusing roller is varied inversely according to the temperature of the pressure roller.

4. A fuser according to claim 3 wherein the means for overriding includes means for controlling energization of a heating element associated with the fusing roller for a length of time which varies inversely with respect to the temperature of the pressure roller.

5. A fuser according to claim 3 wherein the means for overriding includes means for controlling the power applied to the means for heating inversely according to the sensed temperature of the pressure roller.

6. A fuser according to claim 3 wherein the means for overriding includes means for comparing the temperature of the fusing roller with a predetermined threshold and, if the temperature is below the threshold controlling said heat applied according to the temperature of the pressure roller and if the temperature of the fusing roller is above the threshold controlling said heat applied according to the temperature of the fusing roller.

* * * * *